US011558699B2

(12) United States Patent
Durrieu

(10) Patent No.: US 11,558,699 B2
(45) Date of Patent: Jan. 17, 2023

(54) HEARING DEVICE COMPONENT, HEARING DEVICE, COMPUTER-READABLE MEDIUM AND METHOD FOR PROCESSING AN AUDIO-SIGNAL FOR A HEARING DEVICE

(71) Applicant: Sonova AG

(72) Inventor: Jean-Louis Durrieu, Auenstein (CH)

(73) Assignee: Sonova AG, Staefa (CH)

( * ) Notice: Subject to any disclaimer, the term of this patent is extended or adjusted under 35 U.S.C. 154(b) by 67 days.

(21) Appl. No.: 17/183,463

(22) Filed: Feb. 24, 2021

(65) Prior Publication Data

US 2021/0289299 A1 Sep. 16, 2021

(30) Foreign Application Priority Data

Mar. 11, 2020 (DE) ..... 10 2020 203 118.5

(51) Int. Cl.
*H04R 25/00* (2006.01)

(52) U.S. Cl.
CPC ..... *H04R 25/505* (2013.01)

(58) Field of Classification Search
CPC .... H04R 25/505; H04R 25/507; H04R 25/43; H04R 25/554; G10L 21/0232; G10L 25/30; G10L 21/0272
See application file for complete search history.

(56) References Cited

U.S. PATENT DOCUMENTS 10,339,949 B1 7/2019 Dusan
10,355,658 B1 7/2019 Yang
2003/0128855 A1* 7/2003 Moller ..... H04R 25/556 381/314
2007/0083365 A1 4/2007 Shmunk
(Continued)

FOREIGN PATENT DOCUMENTS

EP 2696599 B1 5/2016
EP 2109934 B2 9/2019
(Continued)

OTHER PUBLICATIONS

Extended European Search Report received in EP Application No. 2116150 dated Jul. 20, 2021.
(Continued)

*Primary Examiner* — Tuan D Nguyen
(74) *Attorney, Agent, or Firm* — ALG Intellectual Property, LLC

(57) ABSTRACT

A hearing device component (6) comprises a sensor-unit (8) for receiving an audio-signal (AS), a separation device (9) for separating part-signals ($PS_i$) from the audio-signal (AS), a classification device (10) for classifying the part-signals ($PS_i$) separated from the audio-signals (AS), and a modulation device (11) for modulating the part-signals ($PS_i$), wherein the classification device (10) is communicatively coupled to the modulation device (11) and wherein the modulation device (11) is designed to enable a concurrent modulation of different part-signals ($PS_i$) with different modulation-functions depending on their classification.

19 Claims, 8 Drawing Sheets

(56) References Cited

U.S. PATENT DOCUMENTS

| | | | |
|---|---|---|---|
| 2014/0226825 | A1 | 8/2014 | Edwards |
| 2017/0061978 | A1 | 3/2017 | Wang |
| 2018/0122403 | A1 | 5/2018 | Koretzky |
| 2018/0220243 | A1 | 8/2018 | Nielsen |
| 2019/0206417 | A1 | 7/2019 | Woodruff et al. |

FOREIGN PATENT DOCUMENTS

| | | | |
|---|---|---|---|
| WO | 2013018092 | A1 | 2/2013 |
| WO | 2013149123 | | 10/2013 |

OTHER PUBLICATIONS

Wang, et al."Towards Scaling Up Classification-Based Speech Separation", IEEE Transactions on Audio, Speech, and Language Processing, vol. 21, No. 7, Jul. 2013.

Deutsches Patent—UND Markenamt, office action for DE 10 2020 203 118.5, dated Jan. 20, 2021, Munich, Germany.

Durrieu, J.L. and Jean-Philippe Thiran, Musical audio source separation based on user-selected F0 track, Springer- Verlag Berlin Heidelberg 2012, 2 pages.

D. Wang and G. J. Brown, Computational Auditory Scene Analysis: Principles, Algorithms, and Applications (Wang, D. and Brown, G.J., Eds.; 2006), IEEE Transactions on Neural Networks, vol. 19, No. 1, Jan. 2008, 1 page.

* cited by examiner

HEARING DEVICE COMPONENT, HEARING DEVICE, COMPUTER-READABLE MEDIUM AND METHOD FOR PROCESSING AN AUDIO-SIGNAL FOR A HEARING DEVICE

CROSS-REFERENCED APPLICATION(S)

The present application claims priority to German patent application DE 10 2020 203 118.5, which was filed on Mar. 11, 2020 and titled "Hearing device component, hearing device, computer-readable medium and meth-od for processing an audio-signal for a hearing device," the contents of which are incorporated herein by reference for their entirety.

TECHNICAL FIELD

The inventive technology relates to a hearing device component and a hearing device. The inventive technology further relates to a computer-readable medium. Finally, the inventive technology relates to a method for processing an audio-signal for a hearing device.

BACKGROUND

Hearing devices can be adjusted to optimize the sound output for the user depending on the acoustic environment.

EP 1 605 440 B1 discloses a method for signal source separation from a mixture signal. EP 2 842 127 B1 discloses a method of controlling a hearing instrument. U.S. Pat. No. 8,396,234 B2 discloses a method for reducing noise in an input signal of a hearing device. WO 2019/076 432 A1 discloses a method for dynamically presenting a hearing device modification proposal to a user of a hearing device.

SUMMARY

There is always need to improve a hearing device component. An objective of the inventive technology is in particular to improve the hearing experience of a user. A particular objective is to provide intelligible speech to a user even if an input auditory signal is noisy and has many components. These objectives are solved by a hearing device component according to claim 1 and a hearing device comprising such a component. These objectives are further solved by a computer-readable medium for said hearing device component according to claim 6. These objectives are further solved by a method according to claim 7 for processing an audio-signal for a hearing device.

According to one aspect of the inventive technology, a hearing device component is provided with a separation device for separating part-signals from an audio-signal, a classification device for classifying the part-signals separated from the audio-signals and a modulation device for modulating the part-signal, wherein the modulation device is designed to enable a concurrent modulation of different part-signals with different modulation-functions depending on their classification.

According to an aspect of the inventive technology, there is a combination of a separation of different part-signals from a complex audio-signal, an association of a classification parameter to the individual, separated part-signals and an application of a classification-dependent modulation-function, in particular a classification-dependent gain model, to the part-signal.

It has been found, that by such combination a hearing experience for the user can be improved. It is in particular possible, to modulate different types of sound categories by using different, specific modulation functions. This way, different types of individual source-signals can be specifically modulated, in particular enhanced, suppressed and/or frequency-shifted selectively, in particular in a category-specific manner.

In the following modulation shall in particular mean an input signal level dependent gain calculation. Sound enhancement shall in particular mean an improvement of clarity, in particular intelligibility of the input signal. Sound enhancement can in particular comprise filtering steps to suppress unwanted components of the input signal, such as noise.

According to an aspect of the inventive technology the separation device and/or the classification device and/or the modulation device can be embodied in a modular fashion. This enables a physical separation of these devices. Alternatively, two or more of these devices can be integrated into a common unit. This unit is in general referred to as processing unit.

The processing unit can in general comprise one or more processors. There can be separate processors for the different processing steps. Alternatively, more than one processing step can be executed on a common processor.

According to a further aspect the classification device is communicatively coupled to the modulation device. The classification device in particular derives one or more classification parameter for the separate part-signals, which classification parameters serve as inputs to the modulation device.

The classification parameter can be one-dimensional (scalars) or multi-dimensional.

The classification parameters can be continuous or discrete.

The modulation of the different part-signals can be characterized or described by the modulation-function, for example by specific gain models and/or frequency translations.

According to a further aspect the audio-signal consists of a combination of the part-signals separated therefrom. The audio-signal can further comprise a remaining rest-signal.

The rest-signal can be partly or fully suppressed. Alternatively it can be left unprocessed.

According to a further aspect the modulation device is designed to enable a concurrent modulation of different part-signals with different modulation-functions. The modulation of different part-signals can in particular be executed simultaneously, i. e. in parallel. Different part-signals can also be modulated by the modulation device in an intermittent fashion. This shall be referred to as concurrent, non-simultaneous modulation.

The modulation device is in particular designed to enable a simultaneous modulation of different part-signals with different modulation-functions.

According to a further aspect the audio-signal as well as the part-signals are data streams, in particular streams of audio-data. The part-signals can have a beginning and an end. Thus, the number of part-signals separated from the audio-signal can vary with time. This allows a greater flexibility with respect to the audio processing.

In the extreme, there can be periods, for example periods of absolute silence, in which no part-signals are separated from the audio-signal. There can also be periods, where only a single part-signal is separated from the audio-signal. There can also be periods, during which two, three, four or more part-signals are separated from the audio-signal.

Alternatively, a fixed number of pre-specified or part-signals can be separated from the audio-signal. In this case, one or more of the part-signals can be empty for certain periods. They can in particular have amplitude zero. This alternative can be advantageous, if a modulation device with a fixed architecture is used for modulating the part-signals. This allows a standardized processing protocol.

According to a further aspect the part-signals can have the same time-/frequency resolution as the audio-signal. Alternatively, one or more of the part-signals can have different, in particular lower resolutions. By this the computing power necessary for analyzing and/or modulating the part-signals can be reduced.

According to a further aspect the modulation device comprises a data set of modulation-functions, which can be associated with outputs from the classification device. The modulation-function can in particular associated with certain classification parameters or ranges of classification parameters.

By providing a data set of modulation-functions they can be chosen and applied quickly.

According to a further aspect, the modulation-functions can be fixed. Alternatively, they can be variable, in particular modifiable. They can in particular be modifiable depending on further inputs, in particular external inputs, in particular non-auditory inputs. They can in particular be modifiable by user-specific inputs, in particular manual inputs from the user. The modifiability of the modulation-functions enables a great flexibility for the user-specific processing of different part-signals.

According to a further aspect the data set of modulation-functions can be closed in particular fixed. More advantageously, the data set can be extendable, in particular upgradable. The data set can in particular comprise a fixed number of modulation-functions or a variable number of modulation-functions. The latter alternative is in particular advantageous, if the modulation device has an extendable or exchangeable memory unit.

According to a further aspect, the data set of modulation-functions can be exchangeable. It is in particular advantageous, if the data set of modulation-functions of the modulation-device is exchangeable. Different modulation-functions can in particular be read into the modulation-device, in particular into a memory unit of the modulation-device. They can be provided to the modulation device by a computer-readable medium. By this, the flexibility of the audio-processing is enhanced. At the same time, the memory requirements of the modulation-device are reduced. In addition, having only a limited number of modulation-functions installed in a memory unit of the modulation-device can lead to a faster processing of the part-signals.

According to a further aspect the modulation-functions can be chosen and/or varied dynamically. They can in particular be varied dynamically depending on some characteristics of the audio-signal and/or depending on some external inputs. It has been recognized, that external inputs can provide important information about the temporary environment of the user of a hearing device. External inputs can in particular provide important information regarding the relevance of certain types, i. e. categories, of part-signals. For example, if the user of the hearing device is indoors, traffic noise is likely to be not directly relevant to the user.

The modulation-functions can be varied discretely or smoothly.

The modulation-functions can be varied at discrete time points, for example with a rate of at most 1 Hz, in particular at most 0.5 Hz, in particular at most 0.1 Hz. Alternatively, the modulation-functions can be varied continuously or quasi-continuous. They can in particular be adapted with a rate of at least 1 Hz, in particular at least 3 Hz, in particular at least 10 Hz. The rate at which the modulation-functions are varied can in particular correspond to the sampling rate of the input audio-signal.

The modulation-functions can be varied independently from one part-signal to another.

According to a further aspect the separation device and/or the classification-device and/or the modulation-device comprises a digital signal processor. The separation of the part-signals and/or their classification and/or their modulation can in particular involve solely purely digital processing steps. Alternatively, analog processing steps can be performed as well.

The hearing device component can in particular comprise one or more digital signal processor. It is in particular possible to combine at least two of the processing devices, in particular all three, namely the separation device, the classification device and the modulation device, in a single processing module.

The different processing devices can be arranged sequentially. They can in particular have a sequential architecture. They can also have a parallel architecture. It is in particular possible to execute different subsequent stages of the processing of the audio-signal simultaneously.

According to a further aspect the classification-device comprises a deep neural network. This allows a particular advantageous separation and classification of the part-signals. For the classification temporal memory, spectral consistency and other structures, which, in particular, can be learned from a database, can be taken into account. The classification-device can in particular comprise several deep neural networks. It can in particular comprise one deep neural network per source category. Alternatively, a single deep neural network could be used to derive masks for a mask-based source separation algorithm, which sum to 1, hence learning to predict the posterior probabilities of the different categories given the input audio-signal.

According to a further aspect the sensor-unit comprises multiple sensor-elements, in particular a sensor array.

The sensor-unit can in particular comprise two or more microphones. It can in particular comprise two or more microphones integrated into a hearing-device variable on the head, in particular behind the ear, by the user. It can further comprise external sensors, in particular microphones, for example integrated into a mobile phone or a separate external sensor-device.

Providing a sensor-unit with multiple sensor-elements allows separation of part-signals from different audio-sources based purely on physical parameters.

According to a further aspect, the sensor-unit can also comprise one or more non-acoustic sensors. It can in particular comprise a sensor, which can be used to derive information about the temporary environment of the use of the hearing-device. Such sensors can include temperature sensors, acceleration sensors, humidity sensors, time-sensors, EEG sensors, EOG sensors, ECG sensors, PPG sensors.

According to a further aspect the hearing-device component comprises an interface to receive inputs from an external control unit. By that it is possible, to provide the hearing device component with individual settings, in particular user-specific settings and/or input the external control unit can be part of the hearing-device. It can for example comprise a graphical user interface (GUI). Via the interface, the hearing device component can also receive inputs from other sensors. It can for example receive signals about the environment of the user of the hearing-device. Such signals can be provided to the hearing-device component, in particular to the interface, in a wireless way. For example, when the user enters a certain environment, such as a supermarket, a concert hall, a church or a football stadium, such information can be provided by some specific transmitter to the interface. This information can in turn be used to preselect, which types of part-signals can be separated from the audio-signal and/or what modulation-function are provided to modulate the separated part-signals.

According to a further aspect the hearing device component comprises a memory-unit for transiently storing a part of the audio-signal. It can in particular comprise a memory-unit for storing at least one period, in particular at least two periods, of the audio-signals lowest frequency component to be provided to the user. The memory-unit can be designed to store at least 30 milliseconds, in particular at least 50 milliseconds, in particular at least 70 milliseconds, in particular at least 100 milliseconds of the audio-signal stream.

Storing a longer period of the incoming audio-signal can improve the separation and/or classification of the part-signal comprised therein. On the other hand, analyzing a longer period of the audio-signal generally requires more processing power. Thus, the size of the memory-unit can be adapted to the processing power of the processing device(s) of the hearing-device component.

In addition to the hearing device component described above, the hearing device can comprise a receiver to provide a combination of the modulated part-signals to a user, in particular to a hearing canal of the user.

The receiver can be embodied as loudspeaker, in particular as mini-loudspeaker, in particular in form of one or more earphones, in particular of the so-called in-ear type.

According to one aspect, the hearing-device component and the receiver can be integrated in one single device. Alternatively, the hearing-device component described above can be partly or fully build into one or more separate devices, in particular one or more devices separate from the receiver.

The hearing-device component described above can in particular be integrated into a mobile phone or a different external processing device.

Furthermore, the different processing devices can be integrated into one and the same physical device or can be embodied as two or more separate physical devices.

Integrating all components of the hearing-device into a single physical device improves the usability of such device. Building one or more of the processing devices as physically separate devices can be advantageous for the processing. It can in particular facilitate the use of more powerful, in particular faster processing unit and/or the use of devices with larger memory units. In addition, having a multitude of separate processing units can facilitate parallel distributed processing of the audio-signal.

The hearing device can also be a cochlear device, in particular a cochlear implant.

The algorithm for separating one or more part-signals from the audio-signal and/or the algorithm for classifying part-signals separated from an audio-signal and/or the dataset of modulation-functions for modulating part-signals can be stored transitorily or permanently, non-transitorily on a computer-readable medium. The computer-readable medium is to be read by a processing unit of a hearing-device component according to the preceding description in order to execute instructions to carry out the processing. In other words, the details of the processing of the audio-signals can be provided to a processing or computing unit by the computer-readable medium. Herein the processing or computing unit can be in a separate, external device or inbuilt into a hearing device. The computer-readable medium can be non-transitory and stored in the hearing device component and/or on an external device such as a mobile phone.

With a computer-readable medium to be read by the processing unit it is in particular possible to provide the processing unit with different algorithms for separating the part-signals from the audio-signal and/or different classifying schemes for classifying the separated part-signals or different datasets of modulation functions for modulating the part-signals.

It is in particular possible to provide existing hearing devices or hearing device components with the corresponding functionality. According to a further aspect a method for processing an audio-signal for hearing device comprises the following steps: providing an audio-signal, separating at least one part-signal from the audio-signal in a separation step, associating a classification parameter to the separated part-signals in a classification step, applying a modulation-function to each part-signal in a modulation step, wherein the modulation-function for any given part-signal is dependent on the classification parameter associated with the respective part-signal, wherein several part-signals can be modulated with different modulation-functions concurrently, providing the modulated part-signals to a receiver in a transmission step.

For the transmission step, the modulated part-signals can be recombined. They can in particular be summed together. If necessary, the sum of the modulated part-signals can be levelled down before they are provided to the receiver.

The method can further comprise an acquisition step to acquire the audio-signal.

According to an aspect, at least two of the processing steps selected from the separation step, the classification step and the modulation step are executed in parallel. Preferably all three processing steps are executed in parallel. They can in particular be executed simultaneously. Alternatively, they can be executed intermittently. Combinations are possible.

According to a further aspect at least three, in particular at least four, in particular at least five part-signals can be classified and modulated concurrently. In principle, arbitrarily many part-signals can be classified and modulated concurrently. A limit can however be set by the processing power of the hearing device and/or by its memory. Usually it is enough to classify and modulate at most 10, in particular at most 8, in particular at most 6 different part-signals at any one time.

According to a further aspect the separation step comprises the application of a masking scheme to the audio-signal. The separation step can also comprise a filtering step, a blind-source separation or a transformation, in particular a Fast Fourier Transformation (FFT). In general, the separation step comprises an analysis in the time-frequency domain.

According to a further aspect the modulation-functions to be applied to given part-signals are chosen from a dataset of different modulation-functions. They can in particular be chosen from a pre-determined dataset of different modulation-functions. However, it can be advantageous, to use an adaptable, in particular an extendible dataset. It can also be advantageous to use an exchangeable dataset.

According to a further aspect the modulation-functions are dynamically adapted. By that, it is possible to account more flexibly for different situations, context, numbers of part-signals, a total volume of the audio-signal or any combination of such aspects.

According to a further aspect for each of the part-signals separated from the audio-signal the classification parameter is derived at each time-frequency bin of the audio-signal.

Hereby it is understood, that the audio-signal is divided into bins of a certain duration, in particular defined by the sampling rate of the audio-signal and frequency bins, determined by the frequency resolution of the audio-signal.

The classification parameter does not necessarily have to be derived at each time-frequency bin. Depending on the category of the signal, it can be sufficient, to derive a classification parameter at predetermined time points, for example at most once every 100 millisecond or once every second. This can in particular be advantageous, if the environment and/or context derived from the audio-signal or provided by any other means is constant or at least not changing quickly.

According to a further aspect the separation step and/or the classification step comprises the estimation of power spectrum densities (PSD) and/or signal to noise ratios (SNR) and/or the processing of a deep neuronal net (DNN).

The separation step and/or the classification step can in particular comprise a segmentation of the audio-signal in the time-frequency plane or an analysis of the audio-signal in the frequency domain, only.

The separation step and/or the classification step can in particular comprise classical audio processing only.

According to a further aspect two or more part-signals can be modulated together by applying the same modulation-function to each of them. Advantageously they can be combined first and then the combined signal is modulated. By that, processing time can be saved.

Such combined processing can in particular be advantageous, if two or more part-signals are associated with the same or at least similar classification parameters.

For example, during a conversation, the audio streams corresponding to the speech signals from different persons can be modulated by the same modulation-function.

BRIEF DESCRIPTION OF THE FIGURES

Further details and benefits of the present inventive technology follow from the description of various embodiments with the help of the figures.

DETAILED DESCRIPTION

Physical sound sources create different types of audio events. They can in turn be categorized. It is for example possible to identify events such as a slamming door, the wind going through the leaves of a tree, birds singing, someone speaking, traffic noise or other types of audio events. Such different types can also be referred to as categories or classes. Depending on the context some types of audio events can be interesting, in particular relevant at any given time, others can be neglected, since they are not relevant in a certain context.

For people with hearing loss decoding such events becomes difficult. The use of a hearing aid can help. It has been recognized, that the usefulness of a hearing aid, in particular the use experience of such hearing aid, can be improved by selectively modulating sound signals from specific sources or specific categories whilst reducing others. In addition, it can be desirable, that a user can individually decide, which types of audio events are enhanced and which types are suppressed.

For that purpose a system is needed, which can analyze an acoustic scene, separate source or category specific part-signals from an audio-signal and modulate the different part-signals in a source-specific manner.

Preferably the system can process the incoming audio stream in real time or at least with a short latency. The latency between the actual sound event and the provision of the corresponding modulated signal is preferably at most 30 milliseconds, in particular at most 20 milliseconds, in particular at most 10 milliseconds. The latency can in particular be as low as 6 ms or even less.

Preferably part-signals from separate audio sources, which can be separated from a complex audio-signal can be processed simultaneously, in particular in parallel. After the source specific modulation of at least some of the different types of audio events, they can be combined again and provided to a loudspeaker, in particular an earphone, commonly referred to as a receiver.

It has been further recognized, that it can be advantageous, in particular it can enhance the user experience, if specific, different profiles referred to as modulation functions, such as gain models, are applied simultaneously to different identified sources.

It is in particular proposed to combine tasks such as source separation from an audio-signal, classification of the separated sources and application of source-specific gain models to the classified source signals. In other words, the modulation function, in particular the gain model, used to modulate a part-signal of the audio-signal, which part-signal is associated with a certain type of category of audio events, for example a certain source, is dependent on the classification of the respective part-signal.

In order to separate and/or classify part-signals $PS_i$ from an audio-signal AS one can analyze the audio-signal in the time-frequency-domain.

Figure 1A:
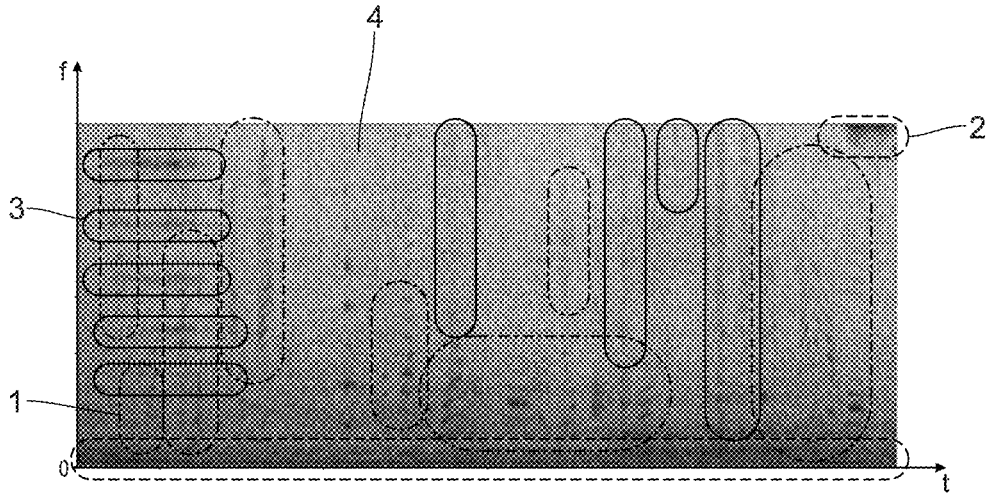
FIG. 1A illustrates an exemplary spectrogram of an audio-signal in accordance with some implementations of the inventive technology.
Figure 1B:
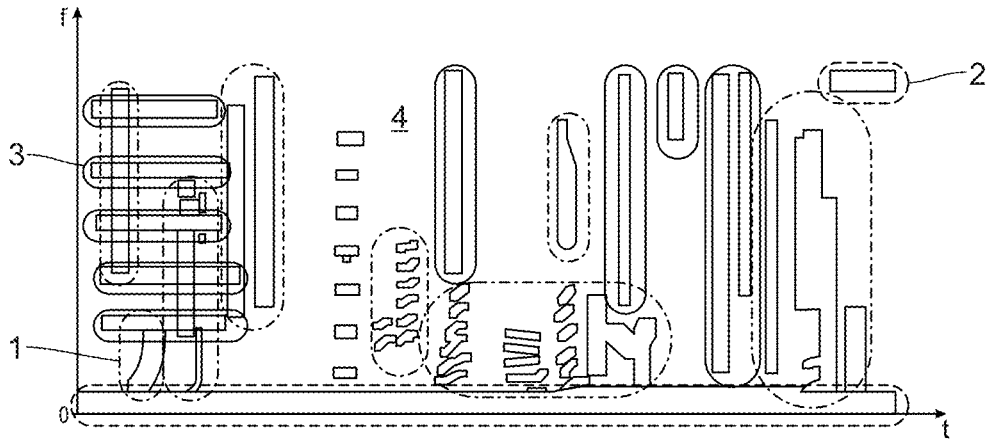
FIG. 1B shows the same spectrogram as FIG. 1A as simplified black and white line drawing signal in accordance with some implementations of the inventive technology.

In FIG. 1A a spectrogram of an exemplary audio-signal is shown. FIG. 1B shows the same spectrogram as FIG. 1A as simplified black and white line drawing. Different types of source-signals can be distinguished by their different frequency components. For illustrative purposes contribution of speech events 1, traffic noise 2 and public transport noise 3 are highlighted in the spectrograms in FIG. 1A and FIG. 1B as well as background noise 4.

Figure 3:
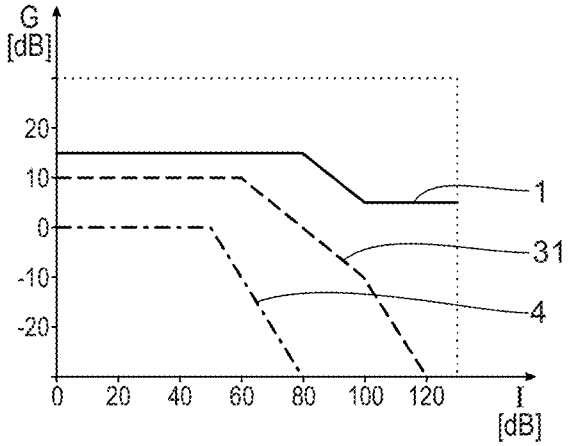
FIG. 3 shows three exemplary different gain models for three different types of audio-sources signal in accordance with some implementations of the inventive technology.

In FIG. 3 three different types of exemplary gain models (gain G vs. input I) for three different types of sources, namely speech 1, impulsive sounds 31 and background noise 4 (BGN) are shown. With this example, speech 1 is emphasized, background noise 4 reduced and impulsive sounds 31 are amplified only up to a set for its output level.

Further gain models are known from the prior art.

To provide more examples of suitable gain models, the following observations are useful:

a. In quiet speech with light noise background and potentially some impulsive events such as a slamming door or rattling cutlery, the background stationary noise can be ignored, while impulsive events should be just slightly amplified and the speech-signals should be enhanced. A training set of different impulsive events can help to define and/or derive a suitable gain model for impulsive sounds.

b. In noisy situations, the background noise should be reduced in order to achieve either a target signal to noise ratio or a target audibility level. However, it should be avoided to remove background noise completely. Such a gain model for background noise keeps the noise audible for comfort, but keeps it below the target speech.

c. In traffic noise, it is important that cars passing by and audio notifications such as traffic light warnings or signal-horns, stay audible for the security of the user. A gain model for warning sounds should be designed with security in mind. The detection of such sound should however mitigate between comfort (low false positive rate) and security (low false negative rate).

d. For music signals different gain models for tonal instruments with sustained sounds, such as string instruments and/or wind instruments, and for percussive instruments with more transient sounds can be applied. Such gain models can be derived by adaptation of the gain model for speech and the gain model for impulsive sounds, respectively.

Figure 2:
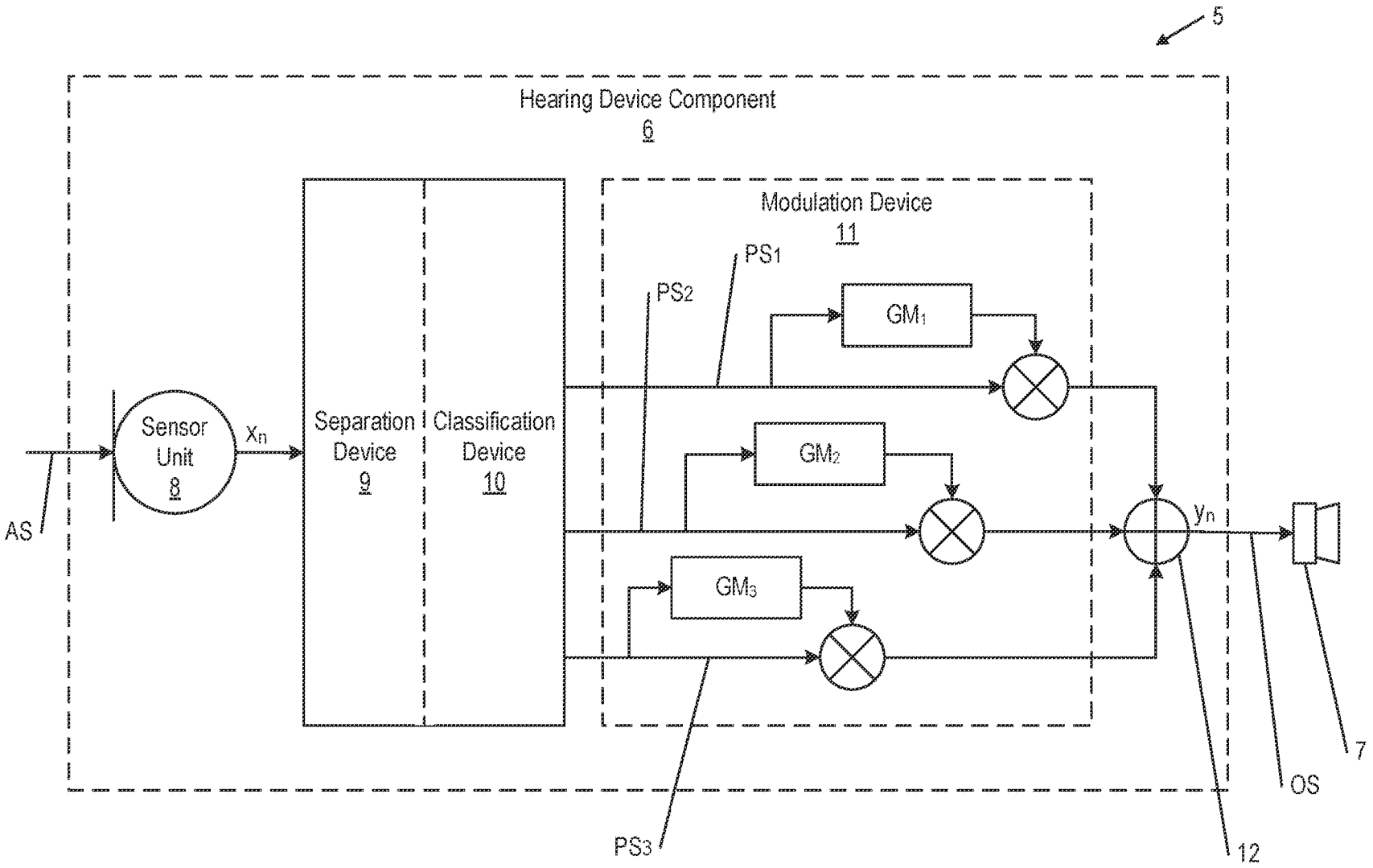
FIG. 2 shows an embodiment of a hearing device with a separation and classification device followed by different gain models signal in accordance with some implementations of the inventive technology.

FIG. 2 shows in a highly schematic fashion the components of a hearing device 5. The hearing device 5 comprises a hearing device component 6 and a receiver 7.

The hearing device component 6 can also be part of a cochlear device, in particular a cochlear implant.

The hearing device component 6 serves to process an incoming audio-signal AS.

The receiver 7 serves to provide a combination of modulated part-signals $PS_i$ to a user. The receiver 7 can comprise one or more loudspeakers, in particular miniature loudspeakers, in particular earphones, in particular of the so-called in-ear-type.

The hearing device component 6 comprises a sensor unit 8. The sensor unit 8 can comprise one or more sensors, in particular microphones. It can also comprise different types of sensors.

The hearing device component 6 further comprises a separation device 9 and a classification device 10. The separation device 9 and the classification device 10 can be incorporated into a single, common separation-classification device for separating and classify part-signals $PS_i$ from the audio-signal AS.

Further, the hearing device component 6 comprises a modulation device 11 for modulating the part-signal $PS_i$ separated from the audio-signal AS. The modulation device 11 is designed such that several part-signals $PS_i$ can be modulated simultaneously. Herein, different part-signals $PS_i$ can be modulated by different modulation-functions depicted as gain models $GM_i$. $GM_1$ can for example represent a gain model for speech. $GM_2$ can for example represent a gain model for impulsive sounds. And $GM_3$ can for example represent a gain model for background noise.

The modulated part-signals $PS_i$ can be recombined by a synthetizing device 12 to form and output signal OS. The output signal OS can then be transmitted to the receiver 7. For that a specific transmitting device (not shown in FIG. 2) can be used.

If the hearing device component 6 is embodied as physically separate component from the receiver 7, the transmission of the output signal OS to the receiver can be in a wireless way. For that, a Bluetooth, modified Bluetooth, 3G, 4G or 5G signal transmission can be used.

If the hearing device component 6 or at least some parts of the same, in particular the synthesizing device 12, is incorporated into a part of the hearing device 5 worn by the user on the head, in particular close to the ear, the output signal OS can be transmitted to the receiver 7 by a physical signal line, such as wires.

The processing can be executed fully internally in the parts of the hearing device worn by the user on the head, fully externally by a separate device, for example a mobile phone, or in a distributed manner, partly internally and partly externally.

The sensor unit 8 solves to acquire the input signal for the hearing device 5. In general, the sensor unit 8 is designed for receiving the audio-signal AS. It can also receive a pre-processed, in particular an externally pre-procced version of the audio-signal AS. The actual acquisition of the audio-signal AS can be executed by a further component, in particular by one or more separate devices.

The separation device 9 is designed to separate one or more part-signals $PS_i$ (i=1 . . . n) from the incoming audio-signal AS. In general, the part-signals $PS_i$ form audio streams.

The separated part-signals $PS_i$ each correspond to a predefined category of signal. Which category the different part-signals $PS_i$ correspond to is determined by the classification device 10.

Depending on the classification of the different part-signals $PS_i$ the gain model associated with the respective classification is used to modulate the respective part-signal $PS_i$.

FIG. 2 only shows one exemplary variant of the components of the hearing device 5 and the signal flow therein. It mainly serves illustrative purposes. Details of the system can vary, for instance, whether the gain models $GM_i$ are independent from one stream to the other.

Figure 4:
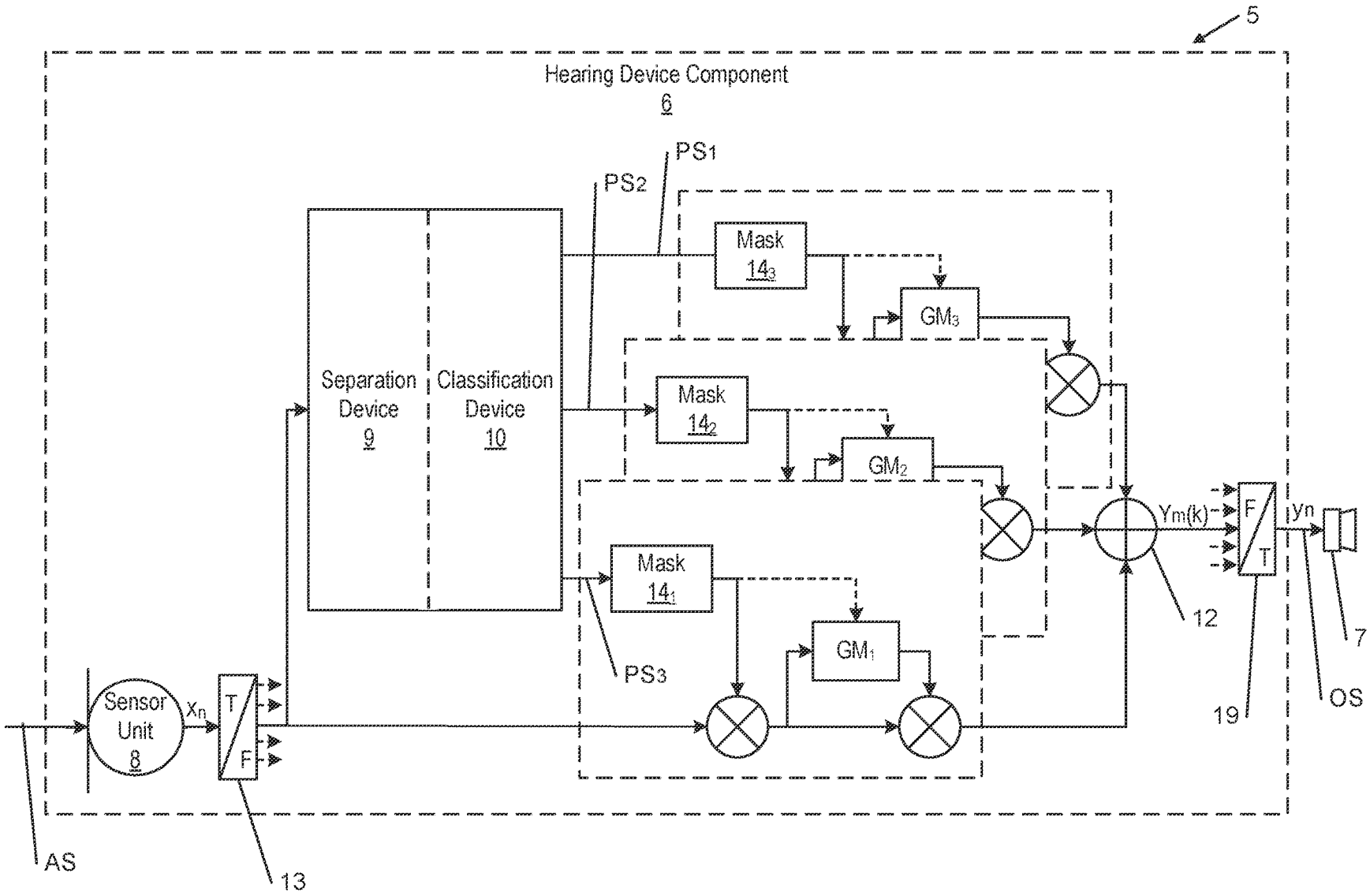
FIG. 4 illustrates a variant of a hearing device according to FIG. 2 with a frequency domain source separation and individual gain model for each source category, with information exchange signal in accordance with some implementations of the inventive technology.

In FIG. 4 a variant of the hearing device 5 is shown, again in a highly schematic way. Same elements are noted by the same reference numerals as in FIG. 2.

In the hearing device 5 according to FIG. 4 the audio-signal AS received by the sensor unit 8 is transformed by a transformation device 13 from the time domain T to the frequency domain F. In the frequency domain F a mask-based source separation algorithm is used. Herein, different masks $\mathbf{14}_i$ can be used to separate different part-signals $PS_i$ from the audio-signal AS. The different masks $14_i$ are further used as inputs to the different gain models $GM_i$. By that, they can help the gain models $GM_i$ to take into account meaningful information such as masking effects.

According to a variant (not shown in the figure) the computed masks $14_i$ can be shared with all the gain models GM in all of the streams of the different part-signals $PS_i$.

After the modulated part-signals $PS_i$ have been recombined, the output signal OS can be determined by a back-transformation of the signal from the frequency domain F to the time domain T, by the transformation device 19.

According to a further variant, which is not shown in the figures, the separation and classification of the part-signals $PS_i$ can be implemented with a deep neural network DNN. Hereby temporal memory, spectral consistency and other structures, which can be learned from a data base, can be taken into account. In particular, the masks $14_i$ can be learned independently, with one DNN per source category.

A single DNN could also be used to derive masks $14_i$ which sum to 1, hence learning to predict the posterior probabilities of the different categories given the input audio-signal AS.

In general, any source separation technique can be used for separating the part-signals $PS_i$ from the audio-signal AS. In particular, classical techniques consisting of estimating power spectrum density (PSD) and/or signal to noise ratios (SNR) to then derive time-frequency masks (TF-masks) and/or gains can be used in this context.

Figure 5:
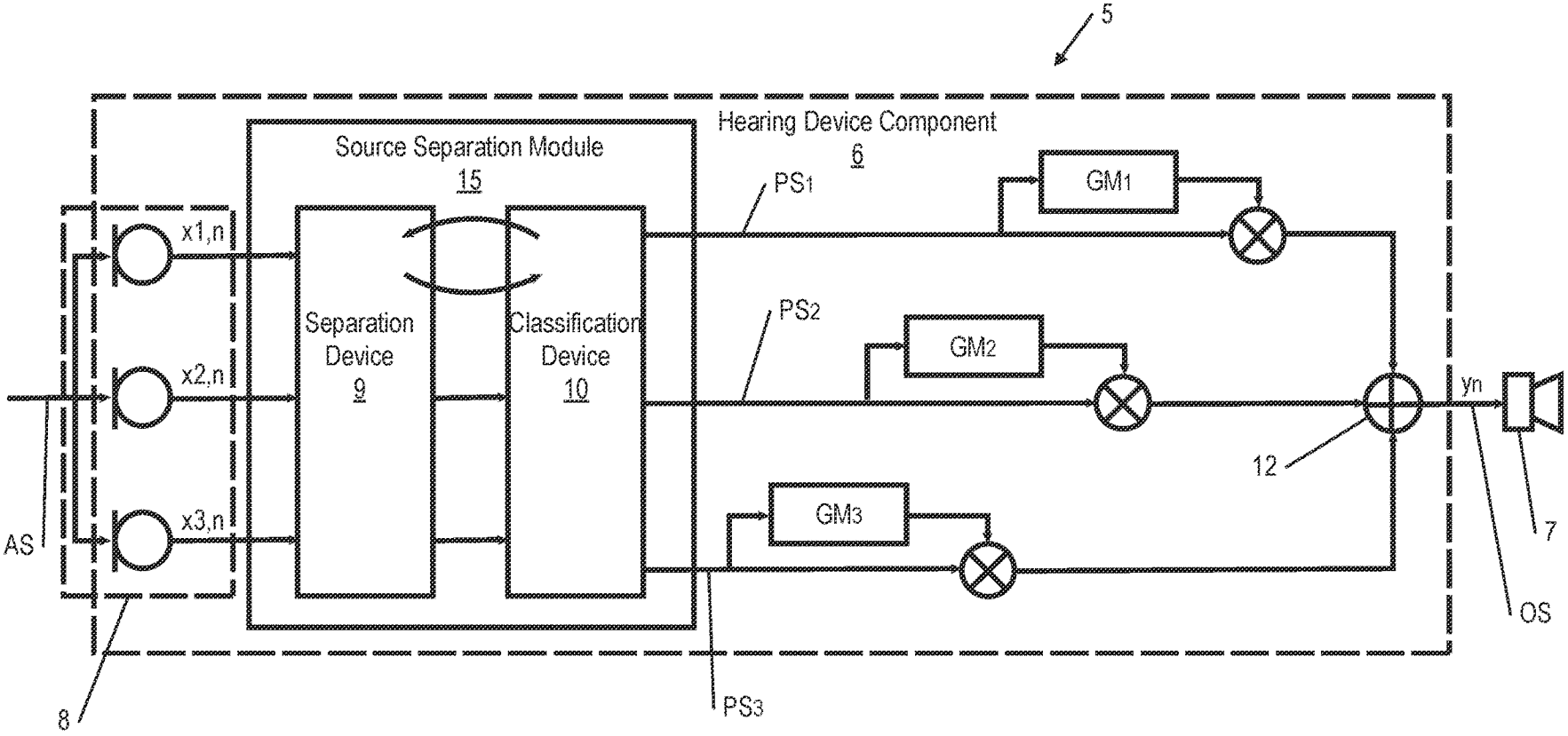
FIG. 5 illustrates yet another variant of a hearing device with a microphone array input and a two-stage separation algorithm signal in accordance with some implementations of the inventive technology.

FIG. 5 shows a further variant of the hearing device 5. Similar components wear the same reference numerals as in the preceding variants.

In this variant the sensor unit 8 comprises a microphone array with three microphones. A different number of microphones is possible. It is further possible to include external, physically separated microphones in the sensor unit 8. Such microphones can be positioned at a distance for example of more than 1 m from the other microphones. This can help to use physical cues for separating different sound sources. It helps in particular to use beam former technologies to separate the part-signals $PS_i$ from the audio-signal AS.

Further, the separation and classification device is embodied as a two-stage source separation module 15. The source separation module 15 as shown in an exemplary fashion comprises a first separation stage as the separation device 9. The separation in that separation stage is based mostly or exclusively on physical cues such as a spatial beam, or independent component analysis. In further comprises a second stage as the classification device 10. The second stage focusses on classifying the resulting beam and recombining them into source types.

The two stages can take advantage one from the other. They can be reciprocally connected in an information transmitting manner.

The first stage can for example be modeled by a linear and calibrated system.

The second stage can be executed via a trained machine, in particular a deep neural network.

Alternatively, the first stage or both, the first and the second stage together can be replaced by a data-driven system such as a trained DNN.

Figure 6:
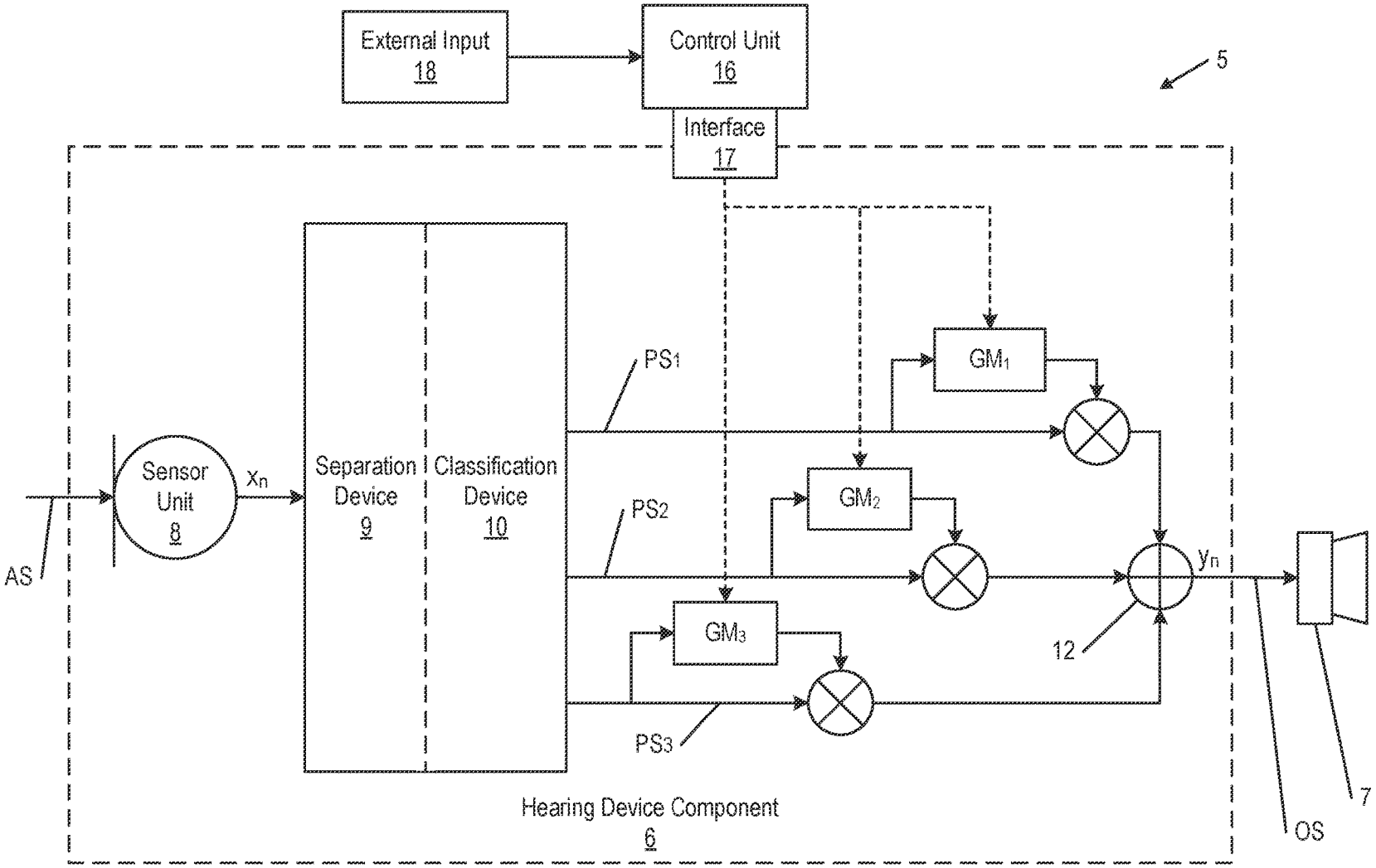
FIG. 6 illustrates yet another variant of a hearing device with an interface to an external control unit signal in accordance with some implementations of the inventive technology.

As shown in FIG. 6, it has been recognized, that it can be advantageous, to provide the hearing device 5, in particular the hearing device component 6, with an interface 17 to an external control unit 16.

The control unit 16 enables interaction with external input 18, for example from the user or an external agent. The interface 17 can also enable inputs from further sensor units, in particular with non-auditory sensors.

Via the interface 17 it is in particular possible to provide the hearing device component 6 with inputs about the environment.

The external input 18 can for example comprise general scene classification results. Such data can be provided by a smart device, for example a mobile phone.

Such interface 17 for external inputs is advantageous for each of the variants described above.

It can further be advantageous, to provide the hearing device component 6 with an interface for user inputs. In particular, user could use a graphical user interface (GUI) in order to mitigate the balance between background noise, impulsive sounds and speech. For that, the user can set the combination gains and/or actually modify the modulation-functions, in particular the individual gain model parameters.

Figure 7:
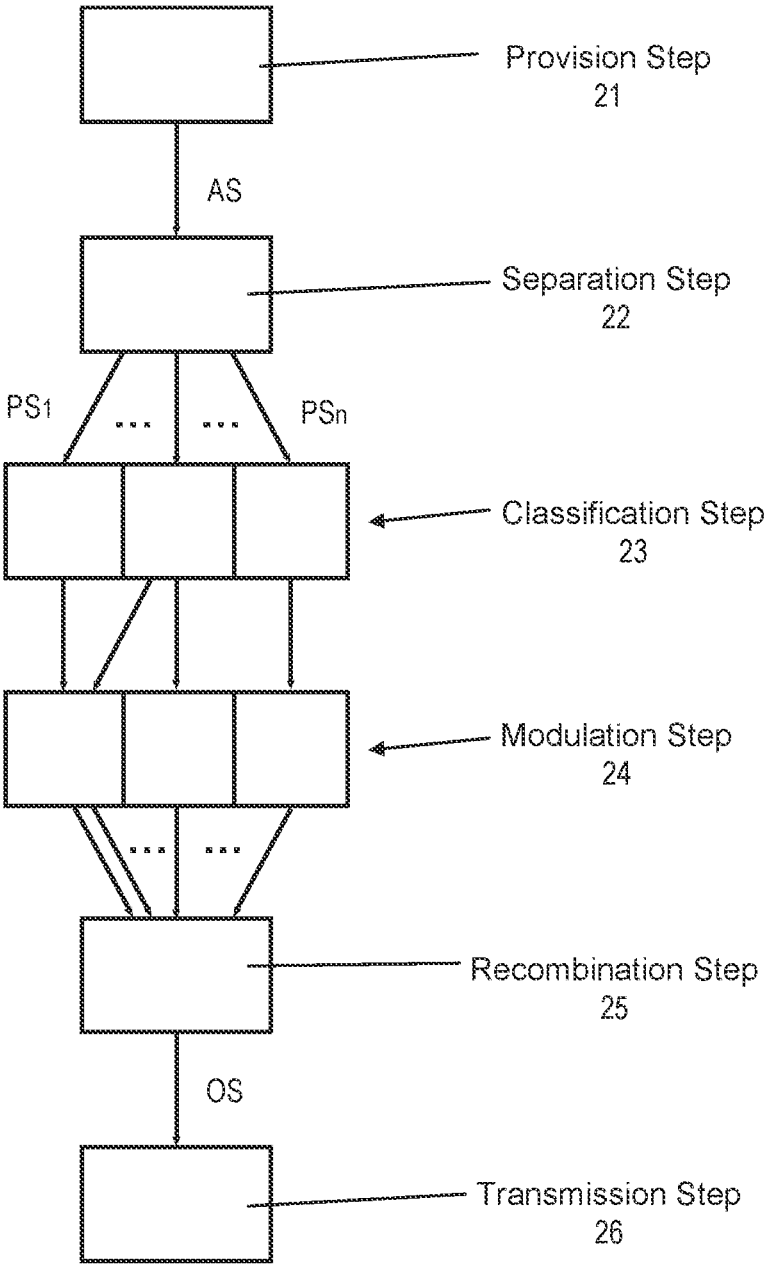
FIG. 7 illustrates in a highly schematic was a flow diagram of a method for processing audio-signals signal in accordance with some implementations of the inventive technology.

FIG. 7 shows in a schematic way a diagram of a method for processing the audio-signal AS of the hearing device 5. The audio-signal AS is provided in a provision step 21.

In a separation step 22 at least one, in particular several part-signals $PS_i$, (i=1 . . . n) are separated from the audio-signal AS.

In a classification step 23 the part-signals $PS_i$ are classified into different categories. For that, a classification parameter is associated with the separated part-signals $PS_i$.

In a modulation step 24 a modulation-function is applied to each part-signal $PS_i$. Herein the modulation-function for any given part-signal is dependent on the classification parameter associated with the respective part-signal $PS_i$.

According to an aspect several part-signals $PS_i$ can be modulated with different modulation-functions concurrently.

In a recombination step 25 the modulated part-signals $PS_i$ are recombined to the output signal OS.

In a transmission step 26 the output signal OS is provided to the receiver 7.

Details of the different processing steps follow from the previous description.

The algorithms for the separation step 22 and/or the classification step 23 and/or the dataset of the modulation-functions for modulating the part-signals $PS_i$ can be stored on a computer-readable medium. Such computer-readable medium can be read by a processing unit of a hearing device component 5 according to the previous description. It is in particular possible, to provide the details of the processing of the audio-signal AS to a computing unit by the computer-readable medium. The computing or processing unit can herein be embodied as external processing unit or can be inbuilt into the hearing device 5.

The computer-readable medium or the instructions and/or data stored thereon may be exchangeable. Alternatively, the computer-readable medium can be non-transitory and stored in the hearing device and/or in an external device such as a mobile phone.

In the following, some aspects, which can be advantageous respective of the other details of the embodiment of the hearing device 5 are summarized in keywords:

The separation of the part-signals $PS_i$ and/or their classification can be done in the time domain, in the frequency domain or in the time-frequency domain. It can in particular involve classical methods of digital signals processing, such as masking and/or filtering, only.

The separation and/or the classification of the part-signals $PS_i$ from the audio-signal AS can also be done with help of one or more DNN.

The hearing device 5 can comprise a control unit 16 for interaction with the user or an external agent. It can in particular comprise an interface 17 to receive external inputs.

At the input stage, the hearing device 5 can in particular comprise a sensor array. The sensor array comprises preferably one, two or more microphones. It can further comprise one, two or more further sensors, in particular for receiving non-auditory inputs.

The number of part-signals $PS_i$ separated from the audio-signal AS at any given time stamp can be fixed. Preferably, this number is variable.

At any given time stamp several different modulation-functions, in particular gain models, can be used simultaneously to modulate the separated part-signals $PS_i$.

Whereas it will usually suffice to modulate each part-signal $PS_i$ by a single modulation-function depending on its classification, it can be advantageous, to modulate one and the same part-signal $PS_i$ with different modulation-functions. Such modulation with different modulation-functions can be done in parallel, in particular simultaneously. Such processing can be advantageous, for example if the classification of the part-signal $PS_i$ is not certain to at least a predefined degree. For example, it might be difficult to decide, whether a given part-signal $PS_i$ is correctly classified as human speech or vocal music. If a part-signal PS is to be modulated by different modulation-functions, it is preferably first duplicated. After the modulation, the two or more modulated signals can be combined to a single modulated part-signal, for example by calculating some kind of weighed average.

The use of different modulation-functions, in particular separate gain models for different types of part-signals $PS_i$, can lead to improvements in the efficiency of the processing of the audio-signal AS. In particular, it makes the global design of the gain model easier.

A further advantage of the proposed system is, that it allows to define very flexibly how to deal with different types of source-signals, in particular also with respect to interferes, such as noise. Furthermore, the classification type source separation also allows to define different target sources, such as speech, music, multi-talker situations, etc.

The invention claimed is:

1. Hearing device component comprising:

a sensor unit for receiving an audio-signal (AS);

a separation device for separating a plurality of source-specific part-signals (PSi) from the audio-signal (AS);

a classification device for classifying each part-signal of the plurality of part-signals (PSi) separated from the audio-signal (AS); and a modulation device for modulating each part-signal of the plurality of part-signals (PSi), wherein the classification device is communicatively coupled to the modulation device and wherein the modulation device is configured to enable a concurrent modulation of each part-signal of the plurality of part-signals (PSi) with a source-specific modulation-function that is based on a classification of the respective part-signal by the classification device.

2. The hearing device component according to claim 1, wherein the modulation device comprises a dataset of modulation-functions, which are associated with outputs from the classification device.

3. The hearing device component according to claim 1, wherein the classification device comprises a deep neural network.

4. The hearing device component according to claim 1, wherein the hearing device comprises an interface to receive inputs from an external control unit.

5. The hearing device component according to claim 1, wherein the hearing device further comprises a receiver to provide a combination of the modulated part-signals (PSi) to a user.

6. A non-transitory computer-readable medium storing instructions, which when executed by a processor, cause a hearing device to perform a method, the method comprising:

providing an audio-signal (AS), separating a plurality of source-specific part-signals (PSi) from the audio-signal (AS), associating a classification parameter with the separated part-signals (PSi), applying a modulation-function to each part-signal (PSi), wherein the modulation-function for any given part-signal (PSi) is dependent on the classification parameter associated with the respective part-signal (PSi), wherein several part-signals (PSi) can be modulated with source-specific modulation-functions concurrently based on the classification parameter associated with the respective part-signal (PSi), providing the modulated part-signals (PSi) to a receiver.

7. The non-transitory computer-readable medium according to claim 6, wherein the classification and the modulation are executed in parallel.

8. The non-transitory computer-readable medium according to claim 6, wherein at least three part-signals (PSi) are classified and modulated concurrently.

9. The non-transitory computer-readable medium according to claim 6, wherein the modulation-functions are dynamically adapted.

10. The non-transitory computer-readable medium according to claim 6, wherein for each of the part-signals (PSi) separated from the audio-signal (AS) the classification parameter is derived at each time-frequency bin.

11. The non-transitory computer-readable medium according to claim 6, wherein the separation and/or the classification comprises the estimation of power spectrum densities (PSD) and/or signal to noise ratios (SNR) and/or the processing of a deep neuronal net (DNN).

12. The non-transitory computer-readable medium according to claim 6, wherein two or more part-signals (PSi) are modulated together by applying the same modulation-function to each of them.

13. A method for processing an audio-signal (AS) for a hearing device comprising the following steps:

providing an audio-signal (AS), separating a plurality of source-specific part-signals (PSi) from the audio-signal (AS), associating a classification parameter to the separated part-signals (PSi), applying a modulation-function to each part-signal (PSi), wherein the modulation-function for any given part-signal (PSi) is dependent on the classification parameter associated with the respective part-signal (PSi), wherein several part-signals (PSi) can be modulated with source-specific modulation-functions concurrently based on the classification parameter associated with the respective part-signal (PSi), providing the modulated part-signals (PSi) to a receiver.

14. The method according to claim 13, wherein at least two of the processing steps selected from the separation step, the classification step and the modulation step are executed in parallel.

15. The method according to claim 13, wherein at least three part-signals (PSi) are classified and modulated concurrently.

16. The method according to claim 13, wherein the modulation-functions are dynamically adapted.

17. The method according to claim 13, wherein for each of the part-signals (PSi) separated from the audio-signal (AS) the classification parameter is derived at each time-frequency bin.

18. The method according to claim 13, the separation and/or the classification comprises the estimation of power spectrum densities (PSD) and/or signal to noise ratios (SNR) and/or the processing of a deep neuronal net (DNN).

19. The method according to claim 13, wherein two or more part-signals (PSi) are modulated together by applying the same modulation-function to each of them.

* * * * *